US010053945B2

(12) United States Patent
Acosta et al.

(10) Patent No.: US 10,053,945 B2
(45) Date of Patent: Aug. 21, 2018

(54) BREAKAWAY OBTURATOR FOR DOWNHOLE

(71) Applicant: Halliburton Energy Services, Inc., Houston, TX (US)

(72) Inventors: Frank Acosta, Duncan, OK (US); Nicholas Frederick Budler, Spring, TX (US); John Key, Duncan, OK (US); Lonnie Helms, Humble, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 81 days.

(21) Appl. No.: 15/031,465

(22) PCT Filed: Nov. 22, 2013

(86) PCT No.: PCT/US2013/071504
§ 371 (c)(1),
(2) Date: Apr. 22, 2016

(87) PCT Pub. No.: WO2015/076831
PCT Pub. Date: May 28, 2015

(65) Prior Publication Data

US 2016/0265302 A1 Sep. 15, 2016

(51) Int. Cl.

| | |
|---|---|
| ***E21B 33/12*** | (2006.01) |
| ***E21B 33/1295*** | (2006.01) |
| *E21B 33/126* | (2006.01) |
| *E21B 34/10* | (2006.01) |
| *E21B 34/00* | (2006.01) |

(52) U.S. Cl.
CPC ..... *E21B 33/12* (2013.01); *E21B 33/1295* (2013.01); *E21B 33/126* (2013.01); *E21B 34/10* (2013.01); *E21B 2034/007* (2013.01)

(58) Field of Classification Search
CPC .... E21B 33/12; E21B 33/1295; E21B 33/126; E21B 2034/007; E21B 34/10; E21B 37/10
See application file for complete search history.

(56) References Cited

U.S. PATENT DOCUMENTS

| | | | | |
|---|---|---|---|---|
| 4,355,686 | A * | 10/1982 | Arendt | E21B 23/08 166/313 |
| 4,893,678 | A | 1/1990 | Stokley et al. | |
| 2002/0104656 | A1* | 8/2002 | Murley | E21B 33/16 166/291 |
| 2003/0066648 | A1 | 4/2003 | McMahan | |

(Continued)

OTHER PUBLICATIONS

International Search Report and Written Opinion issued in related PCT Application No. PCT/US2013/071504 dated Aug. 14, 2014, 14 pages.

(Continued)

*Primary Examiner* — D. Andrews
*Assistant Examiner* — Dany E Akakpo
(74) *Attorney, Agent, or Firm* — John Wusterberg; Baker Botts L.L.P.

(57) ABSTRACT

An obturator for actuating a downhole tool having a central bore. The obturator comprising a body of a size and shape to pass through the central bore of the tool and an engagement member releasably attached to the exterior of the tool body, the engagement member being of a size and shape to engage and actuate the tool.

13 Claims, 5 Drawing Sheets

(56) References Cited

U.S. PATENT DOCUMENTS

| | | | | |
|---|---|---|---|---|
| 2006/0086505 | A1* | 4/2006 | Ross | E21B 31/107 166/301 |
| 2007/0102159 | A1 | 5/2007 | Szarka | |
| 2008/0164028 | A1 | 7/2008 | Winslow et al. | |
| 2010/0294503 | A1* | 11/2010 | Laurel | E21B 33/05 166/335 |
| 2012/0175133 | A1 | 7/2012 | Nikiforuk | |
| 2012/0227980 | A1 | 9/2012 | Fay | |
| 2013/0105144 | A1 | 5/2013 | Jordan et al. | |
| 2013/0112410 | A1 | 5/2013 | Szarka et al. | |
| 2013/0180732 | A1 | 7/2013 | Acosta et al. | |
| 2013/0233572 | A1 | 9/2013 | Helms et al. | |
| 2014/0034310 | A1* | 2/2014 | Andersen | E21B 34/14 166/281 |
| 2015/0114664 | A1* | 4/2015 | Hulsewe | E21B 34/14 166/373 |

OTHER PUBLICATIONS

International Preliminary Report on Patentability issued in related Application No. PCT/US2013/071504, dated Jun. 2, 2016 (12 pages).

Office Action issued in related EP Application No. 13898005.7, dated Jun. 8, 2017 (9 pages).

Office Action issued in related AU Application No. 2013405870, dated Aug. 2, 2017 (6 pages).

* cited by examiner

BREAKAWAY OBTURATOR FOR DOWNHOLE

CROSS REFERENCE TO RELATED APPLICATION

This application is a U.S. National Stage Application of International Application No. PCT/US2013/071504 filed Nov. 22, 2013, which is incorporated herein by reference for all purposes.

STATEMENT REGARDING FEDERALLY SPONSORED RESEARCH OR DEVELOPMENT

Not applicable.

REFERENCE TO A MICROFICHE APPENDIX

Not applicable.

BACKGROUND

The present invention relates to obturators that allow the wellbore to be opened up after the obturator has been used to actuate a downhole wellbore tool.

It is common to use downhole wellbore tools that can be actuated by raising pressure after an obturator moves down the well to contact a seat on the wellbore equipment. Once the wellbore equipment has been actuated opening the wellbore is accomplished using various methods. It is conventional to reopen the well by drilling the obturator out of the wellbore but this process can be time consuming and expensive. In some situations, fluid flow out of the well can be used to lift the obturator out of the well. Some flow-through obturators have an internal passageway extending through the obturator. In flow through obturators, a rupture disk is used to temporarily seal off the passageway and to break when the pressure exceeds a set limit. While this does create an open system, the body of the obturator severely restricts flow, leading to other issues such as elevated pressures and possible pack off at the restriction.

Accordingly, there exists a need for an obturator that does not restrict flow once it has been used to actuate a tool.

SUMMARY

The purpose of this invention is to create a new obturator to operate a downhole tool or similar device that can be released to continue to travel downhole once the tool activation is completed. This obturator design will create an open system with an unrestricted flow path, instead of closing off the string at the tool.

In addition, the obturator can be released to continue displacing fluid as it moves down the well past the actuated tool and allow the released obturator to actuate tools located lower in the well below the actuated tool.

In obturator actuated systems, an obturator is transported down the wellbore to engage a downhole well tool. The terms, "up", "upward", "down" and "downward", when used to refer to the direction in the well bore without regard to the orientation of the well bore. Up, upward and up hole refer to the direction toward the well head. Down, downward, and down hole refer to a direction away from the well head. In these systems, each downhole well tool typically includes a baffle containing seat on which the obturator seats to activate the tool.

BRIEF DESCRIPTION OF THE DRAWINGS

For a more complete understanding of the present disclosure and the advantages thereof, reference is now made to the following brief description, taken in connection with the accompanying drawings and detailed description.

DETAILED DESCRIPTION OF THE EMBODIMENTS

Figure 1:
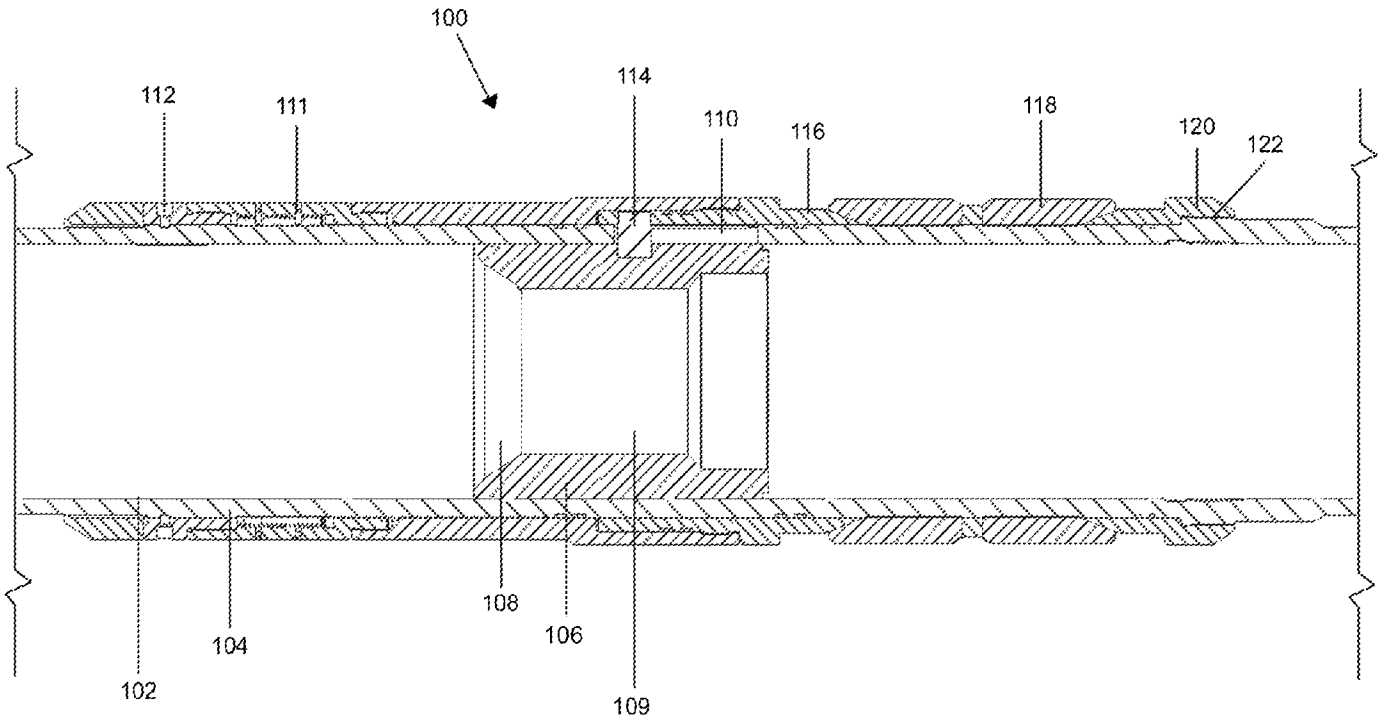
FIG. 1 is a cross-section view of an embodiment of a wellbore tool in the run-in condition of the type which is actuated with an obturator of the present invention.

In the drawings and description that follow, like parts are typically marked throughout the specification and drawings with the same reference numerals, respectively. The drawing figures are not necessarily to scale. Certain features of the invention may be shown exaggerated in scale or in somewhat schematic form and some details of conventional elements may not be shown in the interest of clarity and conciseness.

The following drawings and description will describe an obturator 200 in the form of a dart (displacement type) placed in the well at the surface to land on a baffle in a downhole tool 100 to first shift an internal sleeve in the well tool 100 and then release from the tool and reopen the passageway through the tool. Well pressure acting on the obturator 200 will shift the sleeve to operate the tool 100, and by raising the well pressure even further, the obturator 200 will shear away from the tool 100 and will be continue traveling downhole.

In FIGS. 1-5 a typical well tool 100 is illustrated, attached or connected to a length of well tubing (not shown) at a subterranean location. Unless otherwise specified, any use of any form of the terms "connect," "engage," "couple," "attach," or any other term describing an interaction between elements is not meant to limit the interaction to direct interaction between the elements and may also include indirect interaction between the elements described. In FIGS. 1-5, tool 100 is oriented in the well tubing with the up hole direction to the left side of the page and the down hole direction to the right side of the page. Reference to up or down will be made for purposes of description with "up," "upper," "upward," or "upstream" meaning toward the surface of the wellbore and with "down," "lower," "downward," or "downstream" meaning toward the terminal end of the well, regardless of the wellbore orientation.

The illustrated embodiment, example tool 100 comprises a packer which expands radially to seal the annulus around the tool. In this application, the terms "includes" and "comprises" are used in an open-ended fashion, and thus should be interpreted to mean "including, but not limited to . . . ." While the present disclosure illustrates the tool 100 as a packer, the tool could assume many forms well known in the art, such as, for example sleeve valves, packers and the like.

Tool 100 includes a central bore 102 extending axially through the tool. In this embodiment the tool 100 has a tubular body 104, in which, is mounted an axially reciprocal sleeve 106. Sleeve 106 includes an uphole facing frustoconical shaped seat 108 surrounding a bore 109 extending axially through the sleeve 106. As will be described, the seat 108 is of a size and shape to mate with surfaces on the obturator 200 to close off the central bore 102. A radially extending opening 110 is formed in the body 104. An outer sleeve assembly 111 is mounted concentric with the tool body 104 to axially reciprocate with respect to the body 104. A release mechanism 112 connects sleeve 111 to the tool body 104 to retain it in the "run in position" illustrated in FIG. 1. In this embodiment the release mechanism comprises at least one frangible shear pin mounted to extend between the sleeve 111 on body 104. It is envisioned that other structures for enabling the releasable connection could be used such as those well known in the art including but not limited to shear pins, lock rings, elastomer seals, and magnetic fields.

An actuator pin 114 is mounted on the sleeve 106 and extends through opening 110 in the body to engage a slip actuating sleeve 116. A packer 118 are positioned on the body 104 between slip actuating sleeve 116 and an annular slip support 120. Movement of the annular slip support 120 in the downhole direction is prevented by a shoulder 122 on body 104. As will be appreciated by those of skill in the art, when outer sleeve 111 and actuating sleeve 116 is moved in a downhole direction toward the annular slip support 120 ramp surfaces on the sleeve in support will force slips 118 radially outward to form an anchor with the wellbore wall.

Figure 2:
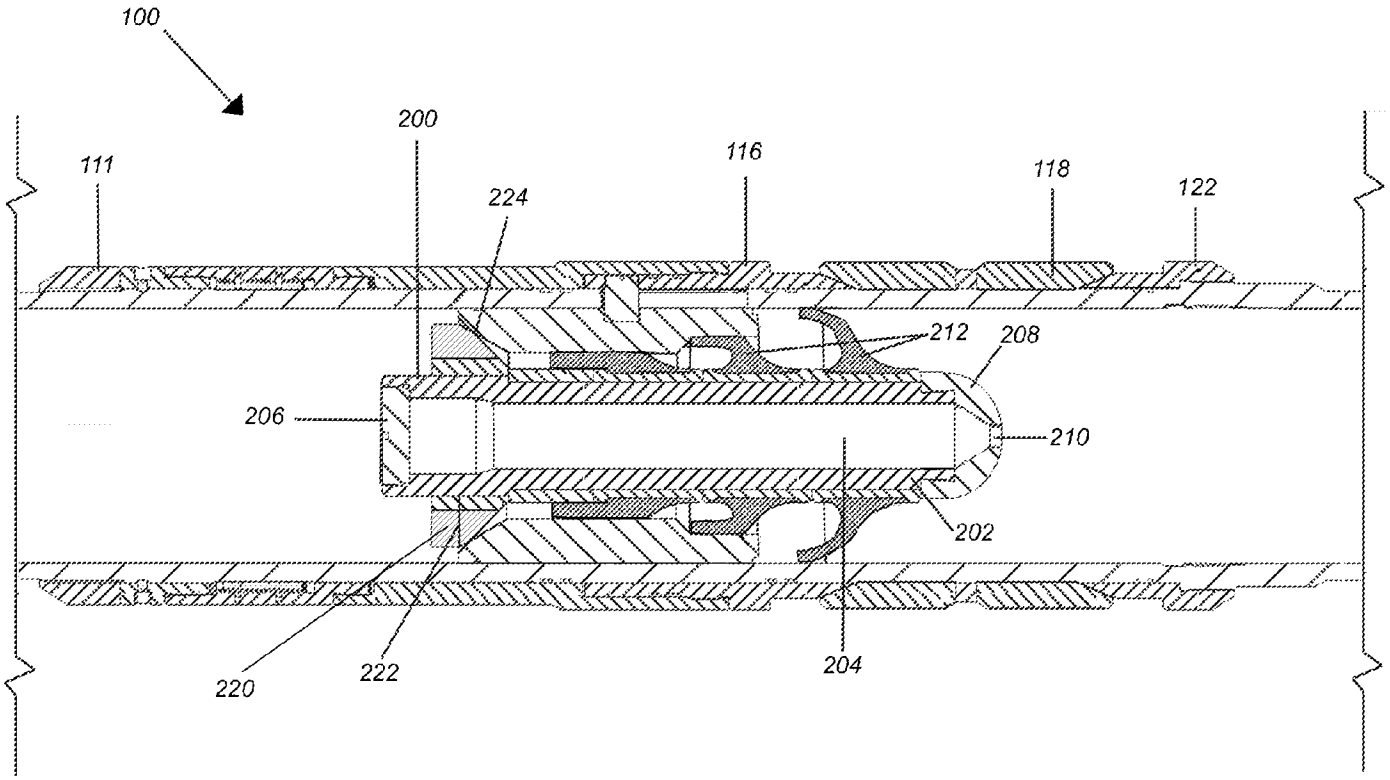
FIG. 2 is a cross-section view of an embodiment of a wellbore tool of FIG. 1, with a obturator seated on the tool before actuating pressure has been applied to the tool.

As illustrated in FIG. 2, an obturator 200 can be inserted in the well at the well head and transported down the well to engage the seat 108 on the well tool 100. Transporting the obturator 200 to the well tool can be accomplished utilizing gravity or fluid pressure, in the illustrated embodiment the obturator 200 is in the form of a dart. Other objects that can be used as the obturator 200 include, but are not limited to: displacement type plugs, darts, free fall plugs, wiper plugs, balls, bypass plugs, foam darts and foam plugs.

The dart 200 comprises a cylindrical body 202. In the illustrated embodiment, the chamber 204 of the body 202 is closed at the up hole end by a plug 206 and by a nose cone 208 at the bottom hole end. A port 210 extends through the body 202 to vent the chamber 204 to the wellbore below the plug 200. The annular shaped resilient wiper cups 212 are mounted on the exterior of body 202. As Illustrated in FIG. 2, wiper cups 212 are of a shape and length to taper in the up hole direction and contact the interior wall 109 of the tool 100.

According to a particular feature of the present disclosure an annular engagement member 220 is connected to the up hole end of the body 202 by a release mechanism 222. In the illustrated embodiment the release mechanism 222 comprises at least one shear pin engaging the body 202 and member 220. It is envisioned that other structures for enabling the releasable connection could be used such as those well known in the art including but not limited to shear pins, lock rings, elastomer seals, and magnetic fields. The annular engagement member 220, includes a downhole directed frustoconical surface 224 of a size and shape to engage and seal against seat 108. Materials used for the body and engagement member can include, but are not limited to: aluminum, composite, phenolic or the like.

Figure 3:
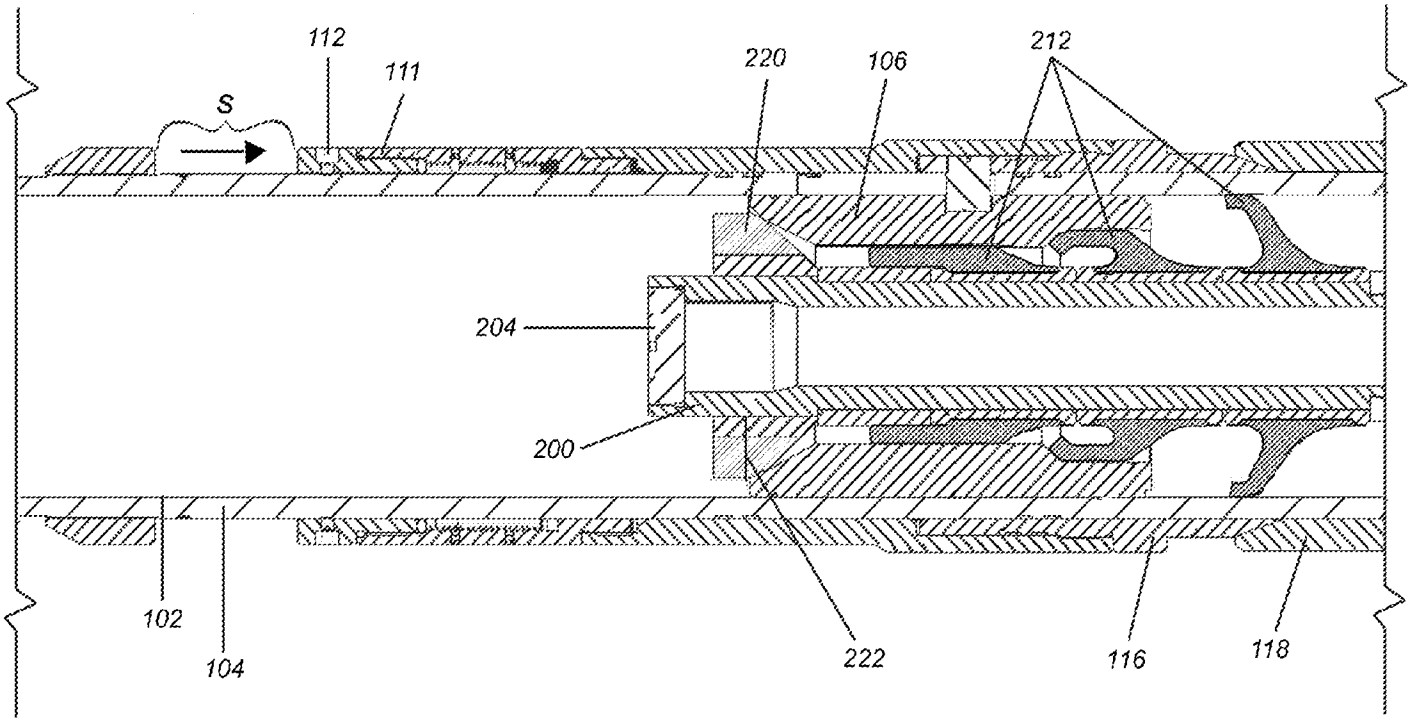
FIG. 3 is a cross-section view of an embodiment of a wellbore tool with an obturator of the present invention seated on the tool after pressure has been applied to actuate the tool.

In FIG. 3 the tool 100 is illustrated with the sleeve 111 shifted downward a distance S to cause the tool to actuate. Shifting the tool downward to the position illustrated in FIG. 3 is accomplished by raising the pressure in the central bore 102 to a point where the downward force acting on assembly of the tool 100 and dart 200 exceeds the shear strength of the pin(s) 112. With the pin(s) 112 broken, pressure in the tubing will cause the sleeve 111 to shift downward to cause the slips 118 to be compressed between the actuating sleeve 116 and slip support 120. As is well known in the industry, ramps on the actuating sleeve and slip support 120 cause the slips on 116 to be forced radially outward into engagement with the wellbore wall.

Figure 4:
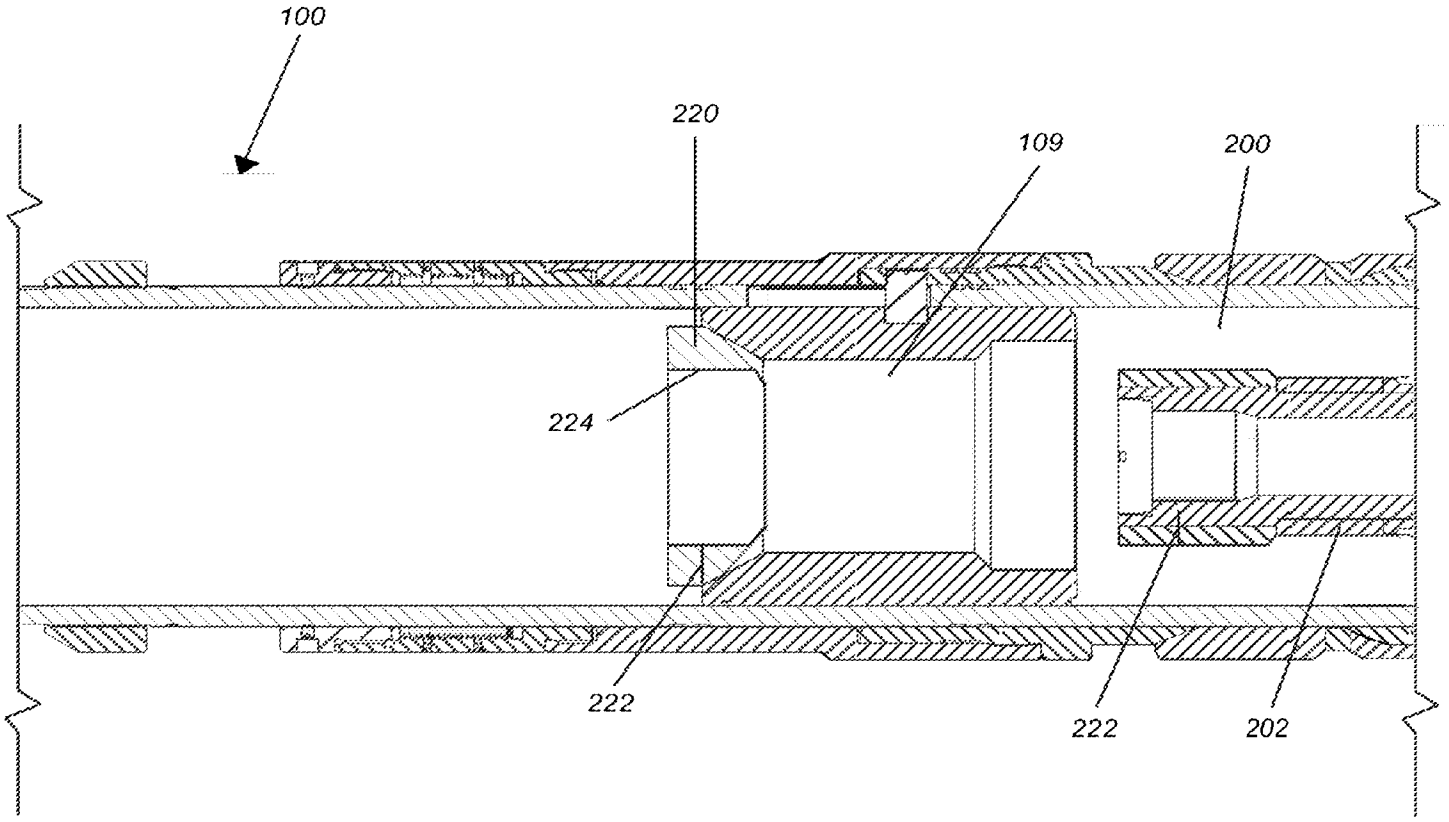
FIG. 4 is a cross-section view of an embodiment of a wellbore tool after pressure has been applied to actuate the tool showing the body of the obturator releasing from the tool after the pressure is increased further.

In FIG. 4 the tool 100 is illustrated with the dart 200 dislodged from the tool opening up the central bore 209 of the sleeve 106. The dart body 202 with its wiper cups 212 is free to continue traveling downhole. To dislodge the dart body 202, pressure in the tubing string is further increased to point where the force generated by the pressure acting on the body 202 exceeds the shear strength of pins 222.

To properly sequence the actuation of the tool and dislodge the dart body, the release mechanisms must be designed to release at different wellbore pressures. For example, to actuate the tool downward actuating force generated by pressure in the wellbore acting on the up hole facing surfaces of the sleeve 106 and dart 200 would need to exceed the retaining force of the mechanism 112. In the present embodiment, the actuating force should be sufficient to cause pins 112 to shear. For example, the shear pins could be selected such that a pressure of 3000 PSI in the wellbore creates a downward force that exceeds the retaining force of the mechanism 112 and thus results in the tool being actuated. To dislodge the dart body 202, the pressure in the wellbore acting on the up hole end of the body 202 must be sufficient to create a force to overcome the restraining force of the release mechanism to 222. For example, the shear pins comprising the release mechanism to 222 could be selected such that a pressure of 5000 psi in the wellbore creates a sufficient downward force the sheer the pins comprising the release mechanism and nothing allowing the dart body 202 to move out of the tool 100.

Figure 5:
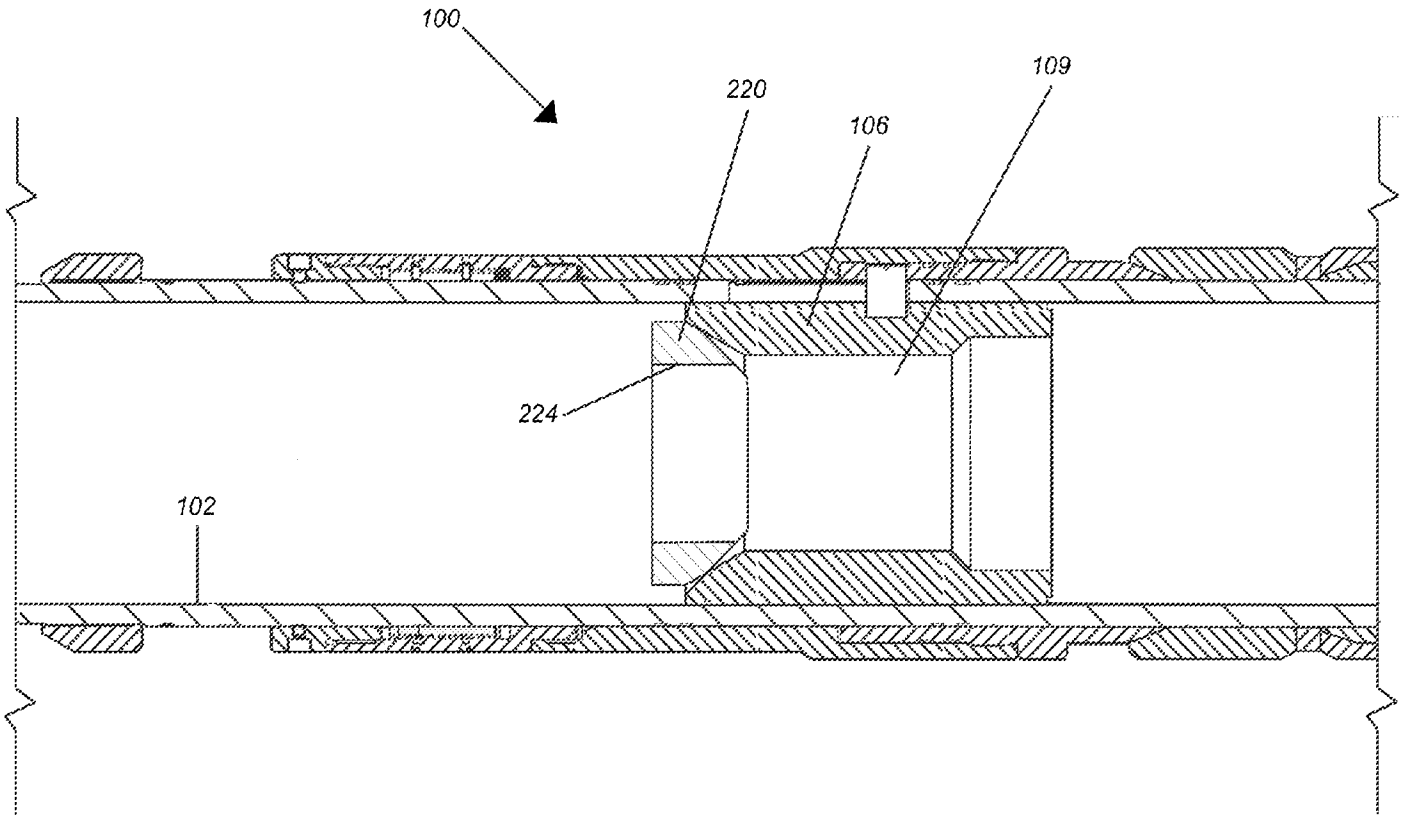
FIG. 5 is a cross-section view of an embodiment of a wellbore tool after obturator has been released from the tool to open the tool bore.

In FIG. 5 the tool 100 is illustrated in the actuated condition with the engagement member 220 separated from the tool body 202. It should be noted that the internal diameter of the central passageway 224 of the engagement member 220 approximates that of the central bore 109 to the sleeve 106.

The components included in this disclosure include an obturator in the form of a dart, that contains an open body 202 section that is integrally connected to the engagement number 220 via shear pins or other temporary containment means. The plug 206 will act as a single unit as it is pumped downhole and as it lands on a sleeve of a tool. As casing pressure is applied, the tool is actuated and as the pressure is increased further, the body 202 will shear away and move down the wellbore. When compared to flow through obturators using a rupture disk to reopen the wellbore, this system creates a more open wellbore and reduces hydraulic lock, increases flow area through the tool, and provides for further displace a fluid if desired.

The various characteristics mentioned above, as well as other features and characteristics described in more detail below, will be readily apparent to those skilled in the art with the aid of this disclosure upon reading the following detailed description of the embodiments and by referring to the accompanying drawings.

Use of broader terms such as comprises, includes, and having should be understood to provide support for narrower terms such as consisting of, consisting essentially of, and comprised substantially of. Accordingly, the scope of protection is not limited by the description set out above but is defined by the claims that follow, that scope including all equivalents of the subject matter of the claims. Each and every claim is incorporated as further disclosure into the specification and the claims are embodiment(s) of the present invention.

What is claimed is:

1. A system, comprising:

wellbore equipment comprising a central bore for connection to a wellbore tubing string at a subterranean location;

an annular seat located in the central bore of the wellbore equipment, wherein the annular seat has an up hole facing surface located at an up hole end thereof and a central bore formed therethrough;

wherein the wellbore equipment further comprises a seat release mechanism holding the annular seat in axial position in the wellbore equipment until an axial force on the annular seat exceeds a first amount; and an obturator, comprising:

an elongated body having an up hole end and a bottom hole end, and a shape to pass through the annular seat;

an annular member arranged at the up hole end of the elongated body and having a downwardly directed surface to engage the up hole facing surface of the annular seat, wherein the annular member comprises a central passageway formed therethrough, wherein an internal diameter of the central passageway is approximately equal to that of the central bore through the annular seat; and a release mechanism connecting the annular member to the elongated body until an axial force on the body exceeds a second amount;

wherein, the system is configured such that with the obturator in the wellbore equipment with the downhole directed surface of the annular member in engagement with the up hole facing surface of the seat, increasing fluid pressure acting on the obturator until the resulting force acting on the seat exceeds the first amount causes the seat release mechanism to release the seat to shift axially together with the obturator, and thereafter increasing the fluid pressure acting on the obturator until the resulting force acting on the body exceeds the second amount causes the release mechanism to release the body to shift axially and pass through the wellbore equipment.

2. The system according to claim 1, wherein the release mechanism comprises a frangible member.

3. The system according to claim 2, wherein the frangible member comprises a shear pin.

4. The system according to claim 1, wherein the release mechanism comprises a lock ring.

5. The system according to claim 1, wherein the release mechanism comprises a magnetic field.

6. The system according to claim 1, wherein the body is cylindrical shaped.

7. The system according to claim 1, wherein the obturator comprises a dart.

8. The system according to claim 1, further comprising:

the tubing string extending into a wellbore to the subterranean location;

wherein the wellbore equipment is connected to the tubing string at the subterranean location.

9. The system according to claim 1, wherein the body comprises a hollow cylinder.

10. A method of using an obturator to actuate wellbore equipment connected to a tubing string at a subterranean location, the method comprising:

providing wellbore equipment having comprising a central bore;

providing an annular seat located in the central bore of the wellbore equipment, the annular seat having an up hole facing surface located at an up hole end thereof, and a central bore formed therethrough, the annular seat being mounted to shift axially upon contact by an obturator, wherein the wellbore equipment further comprises a seat release mechanism holding the annular seat in axial position in the wellbore equipment until an axial force on the annular seat exceeds a first amount;

connecting the wellbore equipment with its central bore in fluid communication with the tubing string;

providing an obturator comprising:

an elongated body having an up hole end and a bottom hole end, and a shape to pass through the annular seat in the wellbore equipment;

an annular engagement member arranged at the up hole end of the elongated body and having a downwardly directed surface to engage the up hole facing surface of the annular seat; and an engagement member release mechanism connecting the annular engagement member to the elongated body until an axial force on the body exceeds a second amount, wherein the annular engagement member comprises a central passageway formed therethrough with an internal diameter that is approximately equal to that of the central bore through the seat;

placing the obturator in the tubing string and transporting the obturator into the wellbore equipment until the annular engagement member contacts the seat with the downhole directed surface of the annular engagement member in engagement with the up hole facing surface of the seat;

increasing the fluid pressure acting on the obturator until the resulting force acting on the seat exceeds the first amount to cause the seat release mechanism to release the seat to shift axially; and thereafter increasing the fluid pressure acting on the obturator until the resulting force acting on the body exceeds the second amount to cause the engagement member release mechanism to release the body to shift axially and pass through the wellbore equipment.

11. The method according to claim 10, wherein one or both of the engagement member release mechanism and the seat release mechanism comprises a frangible member.

12. The method according to claim 10, wherein the obturator and seat are of a size and shape such that the force of the first amount is created by a first pressure and the force of the second amount is created by a second higher pressure.

13. The method of claim 10, further comprising:

setting a packer element into sealing engagement with the tubing string in response to direct engagement of the seat with the packer element during axial shifting of the seat; and after setting the packer element, increasing the fluid pressure acting on the body to cause the engagement member release mechanism to release the body from the annular engagement member.

* * * * *